US008401409B2

(12) United States Patent
Schleusener et al.

(10) Patent No.: US 8,401,409 B2
(45) Date of Patent: Mar. 19, 2013

(54) METHOD AND ARRANGEMENT FOR INKING UP AN APPLICATOR ELEMENT OF AN ELECTROPHOTOGRAPHIC PRINTER OR COPIER

(75) Inventors: Martin Schleusener, Namborn (DE); Uwe Höllig, München (DE)

(73) Assignee: Océ Printing Systems GmbH, Poing (DE)

( * ) Notice: Subject to any disclaimer, the term of this patent is extended or adjusted under 35 U.S.C. 154(b) by 1534 days.

(21) Appl. No.: 11/579,243

(22) PCT Filed: May 9, 2005

(86) PCT No.: PCT/EP2005/005005

§ 371 (c)(1),
(2), (4) Date: Nov. 2, 2007

(87) PCT Pub. No.: WO2005/111735

PCT Pub. Date: Nov. 24, 2005

(65) Prior Publication Data

US 2012/0039620 A1 Feb. 16, 2012

(30) Foreign Application Priority Data

May 14, 2004 (DE) ..... 10 2004 024 047

(51) Int. Cl.
*G03G 15/00* (2006.01)

(52) U.S. Cl. ..... 399/49; 399/270; 399/272

(58) Field of Classification Search ..... 399/49, 399/60, 72, 270, 272
See application file for complete search history.

(56) References Cited

U.S. PATENT DOCUMENTS

| | | | | |
|---|---|---|---|---|
| 4,383,497 | A | 5/1983 | Tajima | |
| 4,686,934 | A | 8/1987 | Kohyama | |
| 4,851,872 | A | 7/1989 | Murasaki et al. | |
| 5,030,977 | A | 7/1991 | Hanson et al. | |
| 5,734,955 | A | 3/1998 | Gruber et al. | |
| 6,285,837 | B1 | 9/2001 | Budnik et al. | |
| 6,917,780 | B2 * | 7/2005 | Ozawa et al. | 399/282 |
| 2004/0002015 | A1 | 1/2004 | Ozawa et al. | |
| 2005/0036806 | A1 | 2/2005 | Hollig et al. | |

FOREIGN PATENT DOCUMENTS

| | | | |
|---|---|---|---|
| DE | 101 37 861 | A1 | 2/2003 |
| JP | 09-211970 | A | 8/1997 |
| WO | WO 03/036393 | A2 | 5/2003 |

* cited by examiner

*Primary Examiner* — Hoang Ngo
(74) *Attorney, Agent, or Firm* — Schiff Hardin LLP

(57) ABSTRACT

In a method or system for generation of a toner image layer with a preset layer thickness on a surface of a photoconductor, the two-component mixture of electrically charged toner particles and carrier particles is directed on an auto-surface of a roller adjacent a surface of an applicator element to be inked. At least a portion of the toner particles is transferred onto the surface of the applicator element. An electrical field is generated that exerts at least one force on a portion of the electrically charged toner particles between the roller and the applicator element. A strength of the electrical field is varied to adjust a layer thickness of a layer of the toner particles transferred onto the surface of the applicator element and thus to adjust a thickness of the toner image layer on the photoconductor. A measurement arrangement detects a thickness of at least one region of the toner image layer inked on the surface of the photoconductor as a real value. The determined real value is compared with a desired value determined by a preset layer thickness, and a strength of the electrical field is controlled dependent on a deviation of the determined real value from the desired value.

20 Claims, 2 Drawing Sheets

METHOD AND ARRANGEMENT FOR INKING UP AN APPLICATOR ELEMENT OF AN ELECTROPHOTOGRAPHIC PRINTER OR COPIER

BACKGROUND

The preferred embodiment concerns a method and an arrangement for inking an applicator element of an electrophotographic printer or copier, in which a two-component mixture (made up of electrically-charged toner particles and ferromagnetic carrier particles) adhering to the external surface of a roller is directed past a surface of an applicator element to be inked. Upon passage of the two-component mixture, at least one part of the toner particles contained in the two-component mixture is transferred to the surface of the applicator element to be inked. The preferred embodiment also concerns a printer or copier for generation of multicolored images on a carrier material.

In developer stations in printer or copier systems for development of charge images generated on a photoconductor, i.e. for development of latent print images, image development methods are used in which the charge image is inked with toner across an air gap. Such methods are, for example, known from U.S. Pat. No. 4,383,497. In such developer stations applicator elements (in particular applicator rollers or continuous bands) are frequently used in order to direct toner material past the charge image to be developed. The charge image is located on a photoconductor, for example on a photoconductor belt or a photoconductor drum. The toner material is typically electrically charged and electrostatically adheres to the surface of the applicator element. Such arrangements for inking of a charge image with the aid if an applicator element are, for example, known from the documents U.S. Pat. No. 5,734,955; WO 03/036393; U.S. Pat. No. 6,285,837 and US 2004/0002015.

The layer thickness of the layer of toner material transferred onto the photoconductor is also not constant, primarily due to fluctuations of the layer thickness of the toner material layer on the applicator element. The fluctuations are caused by a change of the parameters of the two-component mixture, in particular via changes to toner concentration, the tiboelectric charge and the two-component mixture resistance. Fluctuations of the print quality due to a change of parameters of the electrophotography process are also dependent, in particular, on the charging and discharge of the photoconductor. Such short- and long-term fluctuations influence the print quality of the generated print images due to a different inking of print images to be generated. Additional fluctuations of the print quality are possible via mechanical and electrical apparatus adjustments of individual printing groups or individual printing systems, whereby fluctuations in the quality of the generated print results likewise occur that interfere with the fluctuations previously described and can further amplify these.

In other methods for development of charge images, the charge images are not developed across an air gap as described above but rather are developed in direct contact with the photoconductor. To produce the direct contact, the surface of the applicator element contacts the surface of the photoconductor to be inked. Such methods are likewise known from U.S. Pat. No. 4,383,497 (already cited).

In the two alternative developing methods described, a two-component mixture made up of electrically-charged toner particles and ferromagnetic carrier particles is used in order to generate a layer of toner particles on the surface of the applicator element, which layer electrostatically adheres on this surface. The two-component mixture is thereby transported with the aid of what is known as a magnet roller inside which magnet elements are arranged in a stationary manner. The poles of these magnet elements are radially aligned, such that one pole of each magnet element is facing towards the roller surface. Accumulations of the two-component mixture are generated in the region of these poles due to the magnetic field since the ferromagnetic carrier particles are held in the region of the magnet elements.

A portion of the surface of the magnet roller can thereby be directed through what is known as a mixture sump of the developer station, whereby two-component mixture still adhering on the roller surface is scraped off and new two-component mixture is taken up. The quantity of the two-component mixture added onto the roller surface can be limited with the aid of a scraper. What are known as magnet brushes form in the region of the poles, whereby a magnet element is in particular arranged stationary relative to a point with the smallest distance between magnet roller and applicator element in order to generate there a magnet brush that contacts at least the surface the applicator element to be inked. The detaching of the toner particles from the ferromagnetic carrier particles and the take-up of the toner particles on the applicator element can be abetted via the application of what is known as an auxiliary transfer voltage between applicator element and magnet roller system.

Conventional electrophotographic high-capacity printing systems with ≧150 sheets DIN A4 per minute (such as, for example, the Pagestream printer of the applicant) offer the possibility to adjust a degree of basic inking of the print goods, in particular via a contrast setting. Via the adjustment, the basic inking is varied in a small number of levels, whereby this has effects on all significant print quality parameters such as the point diameter, line width, full surface homogeneity and balance of negative and positive algebraic signs. In order to achieve an assured inking of a surface, in the prior art in general the charge image must be developed with a layer thickness of at least 1.5 (up to multiple) layers of toner particles over one another so that a gapless, constantly-inked toner image can be generated on a paper web. Layer thicknesses in the range of 1.5-3 times the toner particle diameter are typical. A high maximum inking of the toner image is achieved via this high layer thickness. A good print quality is thus achieved only given high maximum inking.

Given the known printers, the layer thickness of the regions inked on the photoconductor is achieved via a modification of the electrophotography parameters; the potential difference of the charge image between charged and discharged regions is in particular increased and the bias voltage is varied. The charge image is then developed with a two-component magnet brush, whereby given the higher potential difference a relatively thick toner layer is generated in the photoconductor. However, this influencing of the layer thickness inevitably has as a result an influence on other print quality parameters such as, for example, point diameter, line widths, full surface homogeneity as well as balance of negative and positive algebraic signs.

Two-component printing systems are also known that control the toner quantity that is supplied to the two-component mixture dependent on the layer of toner material generated on the photoconductor. In the printers of the Pagestream printer family of the applicant, the feed of toner material into the two-component mixture of the developer station occurs dependent on the generated toner layer on the photoconductor. Given under-run of a pre-set regular threshold, what is known as fresh toner is supplied from a reservoir (in particular from a buffer) of the developer station. The toner concentration in the two-component mixture in the developer station thereby rises, whereby the ratio of toner particles and carrier particles in the two-component mixture rises and more toner particles are contained in the magnet brush that is used for inking of the photoconductor. However, this regulation primarily serves to supply the quantity of toner material discharged from the two-component mixture via the inking of the charge images to this mixture again and to achieve a constant inking of the generated print images. A flexible adjustment of the toner quantity used for developing the charging device is thereby not possible since changes in the print image due to feed or not-feed of toner material are only effective after a plurality of generated print images, and thus only a relatively lethargic regulation possibility is present.

In the prior art a change of the inking intensity of the charge image can thus only be achieved given simultaneous change of the print quality. For example, the assured and clean reproduction of individual points, the reproduction of exact lines, the generation of smooth edges and the adherence to exact rasters as well as a homogeneous full surface inking are thus negatively influenced given an increase of the inking. A homogeneous inking of surfaces to be inked can thus in fact be achieved via what is known as a saturated inking with high layer thickness of toner particles; however, points are represented too large and rasters are not adhered to, whereby in particular lines no longer have exactly straight edges. Contrarily, given an adjustment of the point size given saturated inking the points are represented too small, given low inking.

Arrangements for inking of charge images in electrophotographic printer or copiers are known from the documents U.S. Pat. No. 4,686,934 A1, JP 4093965 A, DE 101 37 861 A1, U.S. Pat. No. 4,851,872 A1, U.S. Pat. No. 5,734,955 A1, JP 9211970 A and U.S. Pat. No. 5,030,977 A1.

SUMMARY

It is an object to specify a method and arrangement for inking of an applicator element of an electrophotographic printer or copier via which a desired, preset layer thickness of toner particles is generated in a simple manner on regions of the photoconductor to be inked and a high quality of the print image is insured.

In a method or system for generation of a toner image layer with a preset layer thickness on a surface of a photoconductor, the two-component mixture of electrically charged toner particles and carrier particles is directed on an auto-surface of a roller adjacent a surface of an applicator element to be inked. At least a portion of the toner particles is transferred onto the surface of the applicator element. An electrical field is generated that exerts at least one force on a portion of the electrically charged toner particles between the roller and the applicator element. A strength of the electrical field is varied to adjust a layer thickness of a layer of the toner particles transferred onto the surface of the applicator element and thus to adjust a thickness of the toner image layer on the photoconductor. A measurement arrangement detects a thickness of at least one region of the toner image layer inked on the surface of the photoconductor as a real value. The determined real value is compared with a desired value determined by a preset layer thickness, and a strength of the electrical field is controlled dependent on a deviation of the determined real value from the desired value.

DESCRIPTION OF THE PREFERRED EMBODIMENTS

Figure 1:
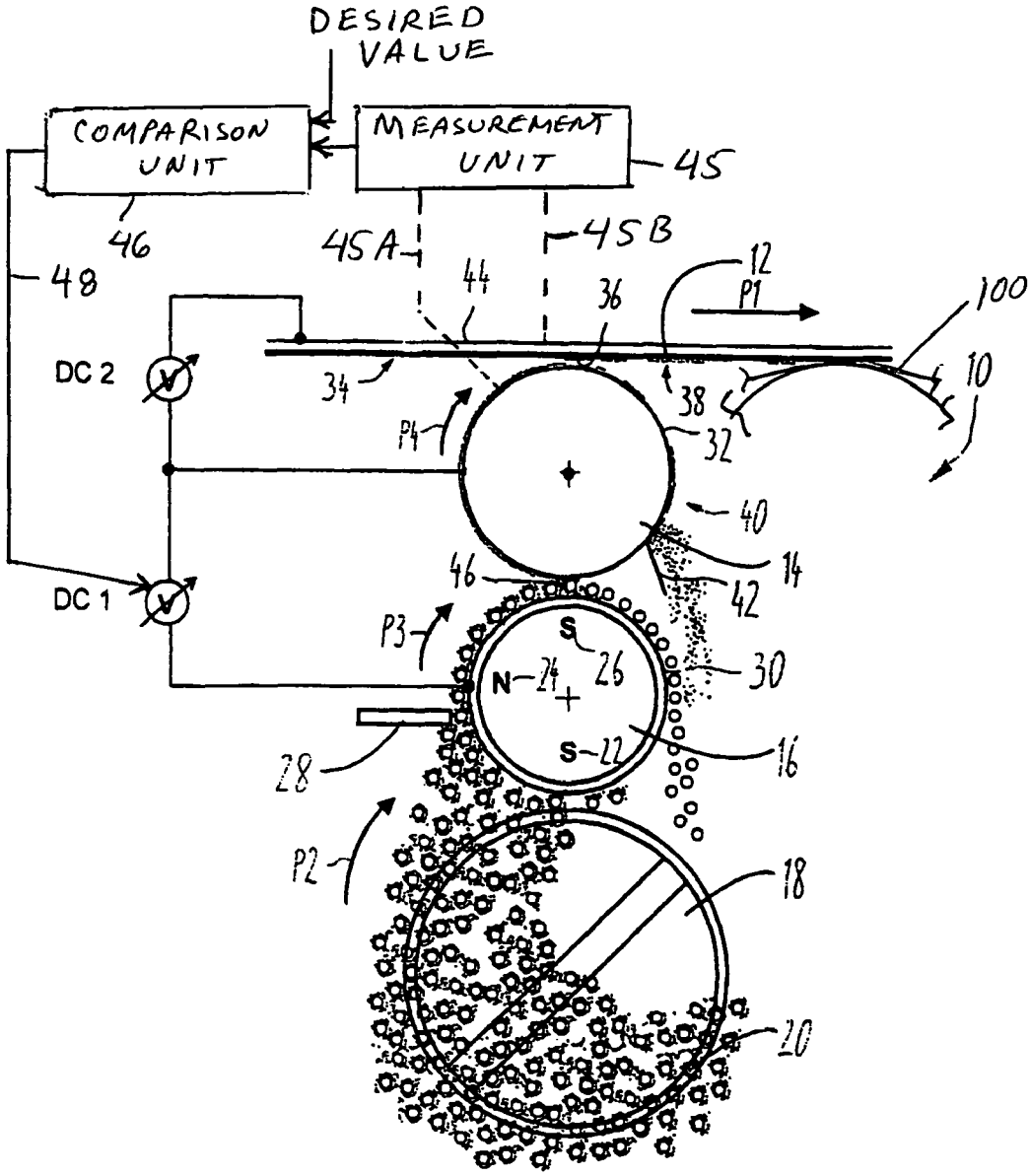
FIG. 1 is an arrangement for inking of a photoconductor belt with the aid of an applicator roller according to a first embodiment of the invention.

For the purposes of promoting an understanding of the principles of the invention, reference will now be made to preferred embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Via the method of the preferred embodiment it is achieved that the layer thickness of the toner particle layer is precisely set or, respectively, regulated to a preset value. The optical density of a print image to be generated can thereby be set in a simple manner, in particular with the aid of further electrophotography parameters in further ranges. Via the inventive method it can also be ensured that a toner particle layer on the surface of the applicator element is generated with a constant (i.e. with a preset) layer thickness, even given changes of the properties of the two-component mixture, in particular given an aging of the carrier particles.

A second aspect of the preferred embodiment concerns a device for generation of a toner particle layer with a preset layer thickness on the surface of an applicator element. This device has a roller on whose outer surface a two-component mixture (made up of electrically-charged toner particles and ferromagnetic carrier particles) adheres.

A device also comprises an applicator element past whose surface the two-component mixture (adhering to the surface of the roller) can be directed.

Furthermore, the device comprises a unit for generation of an electrical field that exerts at least one force on a portion of the electrically-charged toner particles of the two-component mixture which is located between the surface of the roller and the surface of the applicator element to be inked. The device comprises a unit for variation of the strength of the electrical field in order to adjust the layer thickness of the toner particle layer formed by the toner particles transferred onto the surface of the applicator element to be inked. Furthermore, a measurement arrangement is provided to determine a real value as a measure for the layer thickness. The device also comprises a unit for comparison of the determined real value with a desired value determined by the preset layer thickness. The a unit for variation of the strength of the electrical field vary and/or adjust the strength of the electrical field dependent on the deviation of the determined real value from the desired value.

Via such an arrangement it is achieved that the layer thickness generated on the surface of the applicator element exactly achieves a preset value. This preset layer thickness is also achieved with the aid of the of the preferred embodiment device when the mixture properties of the two-component mixture change due to the aging of the toner particles or altered material properties of the toner particles. A high print quality can thus be arranged over a long time span via the of the preferred embodiment arrangement. The layer thickness generated on the surface of the applicator element is set or regulated exactly to the preset value, whereby the layer thickness can also be changed in a simple manner via variation of the desired value.

A third aspect of the of the preferred embodiment concerns a method for adjustment of the inking degree of a toner image to be generated on one side of a carrier material, in which method a two-component mixture (made up of electrically-charged toner particles and ferromagnetic carrier particles) adhering to the outer surface of a roller is directed past a surface of an applicator element to be inked. Upon direction of the two-component mixture, at least a portion of the toner particles contained in the two-component mixture is transferred to the surface of the applicator element to be inked. The toner particle layer generated on the surface of the applicator element to be inked by the transferred toner particles is generated with a preset layer thickness with the aid of the adjustable strength of an electrical field that exerts a force on at least one part of the electrically-charged toner particles of the two-component mixture between the surface of the roller and the surface of the applicator element to be inked. The degree of inking of the toner image to be generated on the side of the carrier material is adjusted with the aid of further electrophotography parameters.

Via this method it is achieved that the layer thickness of the toner particle layer generated on the surface of the applicator element always has a constant, preset layer thickness, whereby the degree of inking of the print image (which in particular can be varied and preset with a control unit via a variation of the brightness adjustment of the print image to be generated) is set not via the layer thickness of the toner particle layer generated on the surface of the applicator element but rather via the further electrophotography parameters, for example via the point size, the auxiliary voltage for transfer of toner material from the surface of the applicator element onto the regions of a photoconductor to be inked and/or from the auxiliary transfer voltage between the photoconductor and a carrier material. If an intermediate toner image carrier is used, the auxiliary transfer voltage between the photoconductor and this intermediate carrier as well as between the intermediate carrier and the carrier material is also an electrophotography parameter via which the degree of inking of the print image (i.e. the brightness of the print image) can be adjusted and/or varied. The method enables a simple and precise control of the brightness of the print image to be generated, meaning that the degree of inking of the print image to be generated on the carrier material can be set in a simple manner. Via the constant layer thickness it is also achieved that a constant, preset layer thickness can also be assumed for changing the degree of inking of the toner image to be generated on the carrier material, whereby the adjustment of the brightness can occur independent of the layer thickness control or layer thickness regulation and thereby more simply. What is known as a drift of the brightness of the generated print images is thereby avoided.

A fourth aspect of the of the preferred embodiment concerns a device for adjustment of the degree of inking of a toner image to be generated on one side of a carrier material, which device has a roller on whose outer surface a two-component mixture (made up of electrically-charged toner particles and ferromagnetic carrier particles) adheres. The device also comprises an applicator element past whose surface to be inked the two-component mixture adhering on the surface of the roller can be directed. A unit is provided for generation of an electrical field with an adjustable field strength, whereby the electrical field exerts at least one force on a portion of the electrically-charged toner particles of the two-component mixture between the surface of the roller and the surface of the applicator element to be inked. Via the setting of a suitable electrical field strength the toner particle layer generated on the surface of the applicator element to be inked via the toner particles transferred onto this surface to be inked has a preset layer thickness. Furthermore, the device comprises a unit for adjusting further electrophotography parameters to adjust the degree of inking of the toner image to be generated on the side of the carrier material.

Via such a device it is achieved that the degree of inking of the toner image to be generated or of the print image to be generated is varied and set independent of the layer thickness generated on the surface of the applicator element. The layer thickness of the toner particle layer generated on the surface of the applicator element can thereby be adjusted independent of the further electrophotography parameters, whereby only the further electrophotography parameters must be varied in a suitable manner to adjust the degree of inking or the brightness. Given the variation of the further electrophotography parameters a constant, preset layer thickness can thus be assumed. The brightness or the degree of inking can thereby be adjusted with high precision. Effects of aging appearances (in particular of the carrier particles of the two-component mixture) on the degree of inking or on the brightness of the toner image/print image generated on the carrier material do not occur given the device of the preferred embodiment.

A fifth aspect of the preferred embodiment concerns a method for inking of an applicator element of a printer or copier, in which method a two-component mixture (made up of electrically-charged toner particles and ferromagnetic carrier particles) adhering on the outer surface of a roller is directed past a surface of an applicator element to be inked. Given direction of the two-component mixture, at least a portion of the toner particles contained in the two-component mixture is transferred onto the surface of the applicator element to be inked. An electrical field is generated that exerts a force at least on a portion of the electrically-charged toner particles of the two-component mixture that is located between the surface of the roller and the surface of the applicator element to be inked.

Via this method it is achieved that the optical density of the generated print image can be adjusted in wide ranges in a simple manner without influencing other properties of the print quality, in particular without influencing the point diameter of individual points, the line thickness, the edge smoothness, the homogeneous full surface inking and the raster mapping. Via the provision of an applicator element it is also achieved that a layer of toner particles already generated on the surface of the photoconductor is not damaged again by carrier particles. Via the method a continuously-variable adjustment of the layer thickness of the toner particle layer generated on the applicator element is in particular possible and a print image impairment due to what are known as depletion effects is precluded. The change of the layer thickness independent of other print parameters is in particular achieved in that it is significantly dependent only on the set electrical field strength. A constant print quality given an independent change of the inking of the print image to be inked is thereby achieved, whereby a distinctly lower toner consumption and thus low printing costs at higher quality of the print good is achieved. Via the method in particular what are known as over-tonerings of the latent print image do not have to occur in order to insure an assured inking of even large surfaces.

Via the method it is also achieved that other parameters of the electrophotography process, in particular the potential difference between charged and discharged regions of the photoconductor and the potential difference between applicator element and photoconductor, can be set independent of the layer thickness of the toner material transferred on the photoconductor, which layer thickness is generated on the photoconductor with the aid of the applicator element. The layer thickness can thereby be changed very quickly by changing the potential difference between roller and applicator element. Via the method it is also achieved that the electrophotography process is stabilized and a high quality of the generated print image is achieved. Furthermore, the lifespan of the two-component mixture is increased since an increase of the degree of inking does not necessarily have as a consequence an increase of the toner particle proportion in the two-component mixture. With the aid of the method mixing parameters changing over the long term (such as, for example, the mixture resistance), can also be compensated in a simple manner via increase of the electrical field strength, whereby the usable time span of the carrier particles is increased and costs of consumable materials are decreased.

A regulation of the layer thickness can also advantageously occur in that the inking of an inked region of the print image on the photoconductor or a subsequent carrier material is detected with the aid of a sensor arrangement and the strength of the electrical field is adjusted dependent on the detected degree of inking. Alternatively or additionally, the degree of inking detected by the sensor arrangement can be used for automatic adjustment of the basic inking in the printer or copier.

A sixth aspect of the preferred embodiment concerns an arrangement for inking of an applicator element of an electrophotographic printer or copier. The arrangement comprises a roller on whose outer surface adheres a two-component mixture made up of electrically-charged toner particles and ferromagnetic carrier particles. The arrangement also comprises an applicator element past whose surface to be inked two-component mixture adhering on the surface of the roller can be directed. The arrangement also comprises means for generation of an electrical field that acts on at least a portion of the two-component mixture that is located between the surface of the roller and the surface of the applicator element to be inked, whereby the electrical field transfers at least a portion of the toner particles present in the two-component mixture onto the surface of the applicator element to be inked given passage of the two-component mixture. A control unit controls the strength of the electrical field such that the transferred toner particles generate a preset layer thickness on the surface to be inked.

Via such an arrangement it is achieved that the layer thickness of a layer of toner material to be applied on a photoconductor can be adjusted in a simple manner, independent of further electrophotography parameters. The layer thickness of toner layer generated on the regions of a charge image to be inked is thus essentially independent of the potential difference between regions of the photoconductor to be inked and regions of the photoconductor that are not to be inked. By controlling the transfer voltage, carrier particles can also be used in the two-component mixture over a relatively long time span since, by changing the strength of the electrical field, a desired layer thickness of the toner layer generated on the applicator element can be achieved. Via this arrangement a very fast and flexible change of the layer thickness of the toner layer generated on the applicator element is also possible.

A seventh aspect of the preferred embodiment concerns a printer or copier for generation of multi-colored print images on a carrier material that has at least two developer stations. The first developer station comprises electrically-charged toner particles of a first color and the second developer station comprises electrically-charged toner particles of a second color differing from the first color. In each of the developer stations an applicator element is provided on whose surface to be inked is respectively generated a toner particle layer (made up of toner particles comprised in the respective developer station) with a preset layer thickness according to a method of the preferred embodiment.

Such a printer or copier can generate print images at a high quality in a simple manner since, in particular given multi-color printing for generation of combination colors, the toner quantities of the respective color separation are of decisive importance for the color tone of the combination color. The layer on the to-be-inked surface of the applicator element arranged in the respective developer station has a defined layer thickness, independent of the aging of the carrier particles comprised in the respective developer station. In particular given printings with a plurality of developer stations, via the execution of the method steps of the method, developer stations can thus be used that have carrier particles with different deterioration states, whereby even in these developer stations a high print quality is achieved via the generation of a constant, preset layer thickness on the surface of the respective applicator element.

An eighth aspect of the preferred embodiment concerns a printer or copier for generation of multi-colored print images on a carrier material, which printer or copier has at least two developer stations. The first developer station comprises electrically-charged toner particles of a first color and the second developer station comprises electrically-charged toner particles of a second color differing from the first color. Each developer station comprises an arrangement according to any of the preceding aspects.

Constant, preset layer thicknesses are generated on the surface of the respective applicator element via such a printer or copier, whereby high-quality print images are also achieved in multi-color printing given printing of a plurality of toner images atop one another.

A developer unit 10 for development of a charge image contained on a photoconductor belt 12 is shown in FIG. 1. The photoconductor belt 12 is driven in the direction of the arrow P1 with essentially constant speed. The storage unit 10 comprises an applicator roller 14, a magnet roller 16 and a mixing wheel 18. The lower part of the mixing wheel 18 is located in what is known as the mixture sump of the developer unit 10, in which is comprised a two-component mixture made up of toner particles and carrier particles. The toner particles are electrically charged and adhere to the ferromagnetic carrier particles. The carrier particles essentially serve to transport the toner particles with the aid of the magnet roller 16.

Three magnet elements 22, 24, 26 are arranged stationary inside the magnet roller 16. The magnet elements are permanent magnets, in particular natural magnets, that extend inside the roller 16 over its entire length. The longitudinal axes through the poles of the magnet elements 22, 24, 26 are radially aligned, whereby the south poles of the magnet elements 22 and 26 are aligned towards the roller surface and the north pole of the magnet element 24 is aligned towards the roller surface. The counter-poles of the magnet elements 22, 24, 26 are not shown. What are known as magnet brush are formed on the surface of the magnet roller 16 in the region of the magnet elements 22, 24, 26, via which magnet brushes accumulations (raised in these regions) made up of toner particles and carrier particles are formed. The ferromagnetic carrier particles (together with toner particles adhering to these) are held in the region of the magnet elements by the magnetic field of these magnet elements 22, 24, 26 and are aligned along the field lines of the magnetic field, whereby the projecting brush shape is generated.

The mixing wheel 18 is driven in the direction of the arrow P2, whereby the toner particles and carrier particles located in the mixture sump 20 are stirred, whereby the toner particles are triboelectrically charged via the friction generated in the stirring. The two-component mixture made up of toner particles and carrier particles is flung or whirled to the magnet roller 16, whereby a portion of the two-component mixture impinges on the surface of the magnet roller 16 and in particular is held on the surface of the magnet roller 16 via the magnetic fields of the magnet elements 22 and 24. The mixture made up of toner particles and carrier particles are conveyed on the surface of the magnet roller 16 via the movement of the magnet roller 16 in the direction of the arrow P2. The layer thickness of the layer of the two-component mixture located on the surface of the magnet roller 16 is limited by a scraper 28.

The magnet roller 16 comprises a metal casing 30 that is coated with a ceramic layer with a suitable roughness and has good bonding properties for transport of the two-component mixture. The metal casing 30 is connected with a first potential of a direct voltage source DC1. The direct voltage source DC1 can be adjusted in a continuously-variable manner, whereby the voltage of the direct voltage source DC1 is adjusted with the aid of a control unit.

The applicator roller 14 comprises a metal casing 32 that is connected with a second potential of the direct voltage source DC1. An electrical field is thus generated between the metal casing 32 of the applicator roller 14 and the metal casing of the magnet roller 16, whereby the electrical field is strongest at the point 46 with the smallest separation between the applicator roller 14 and the magnet roller 16. The electrical field between the applicator roller 14 and the magnet roller 16 leads to the situation that toner particles adhering to the carrier particles detach from the carrier particles and settle on the surface of the applicator roller 14. The quantity of the toner particles detached from the two-component mixture and settled on the applicator roller 14 is thereby dependent on the potential difference between the first potential and the second potential, i.e. on the voltage generated by the direct voltage source DC1.

The toner particles deposited on the surface of the applicator roller 14 adhere to this surface electrostatically. The layer thickness of the toner particle layer generated on the applicator roller 14 can thus be set in a simple manner via the adjusted voltage at the voltage source DC1. A charge image, i.e. a latent print image, is located in the region 34 on the photoconductor belt 12. The photoconductor belt 12 is moved in the direction of the arrow P1, whereby at the same time the applicator roller 14 is driven in the direction of the arrow P4. The circulation speed of the photoconductor belt 12 and the circulation speed of the applicator roller 14 are essentially the same, such that no speed difference occurs in the region of a transfer point 36 between photoconductor belt 12 and applicator roller 14.

The regions of the charge image 34 to be inked are inked with toner material in the transfer printing region 36, whereby essentially the entire toner material layer located on the surface of the applicator roller 14, which toner material layer is situated opposite the region to be inked, is transferred onto the photoconductor belt 12. A toner image that essentially corresponds to the print image to be generated is thus located on the photoconductor belt in the region 38 of the photoconductor belt 12. A toner image that corresponds to the negative of the print image in the region 38 remains behind in the region 40 on the applicator roller 14. Toner material still located on the surface of the applicator roller 14 is abraded from its surface with the aid of a scraper 42. The abraded toner material falls back into the mixture sump and is thereby resupplied to the electrophotography process.

The possible toner material still present on the surface of the applicator roller 14 in the regions from which the layer of toner material has been transferred onto the photoconductor belt 12 is removed from the surface of the applicator roller 14 with the aid of the scraper 42. Further cleaning devices for removal of the toner material remaining on the applicator roller 14 and for cleaning of the surface of the magnet roller 16, as they are in particular known from the international patent application WO 03/036393 A2, can be provided in addition to or as an alternative to the scraper 42. The disclosure contained in this patent application is herewith incorporated by reference into the present specification. The design of the magnet roller 16 is also described in detail in this application. This disclosure is also herewith incorporated by reference into the present specification.

An air gap between the surface of the applicator roller 14 and the photoconductor belt 16 is provided in the transfer printing region 36, such that the development with toner material of the charge image contained in the region 34 occurs across an air gap. The photoconductor belt 12 comprises an electrically-charged layer 44 that is connected with a second potential of a second direct voltage source DC2. The first potential of the direct voltage source DC1 is connected with the second potential in the direct voltage source DC1 and thus is connected with the metal casing 32 of the applicator roller 14. An electrical field between the electrically-charged layer 44 and the metal casing 32 is thus generated with the aid of the direct voltage source DC2, whereby the transfer printing of the toner particles from the applicator roller 14 onto the regions 34 of the photoconductor belt 12 to be inked is at least abetted. The direct voltage source DC2 can advantageously also be adjusted in a continuously-variable manner, such that the strength of the electrical field between the metal casing 32 and the electrically-charged layer 44 can be regulated in a large range.

Figure 2:
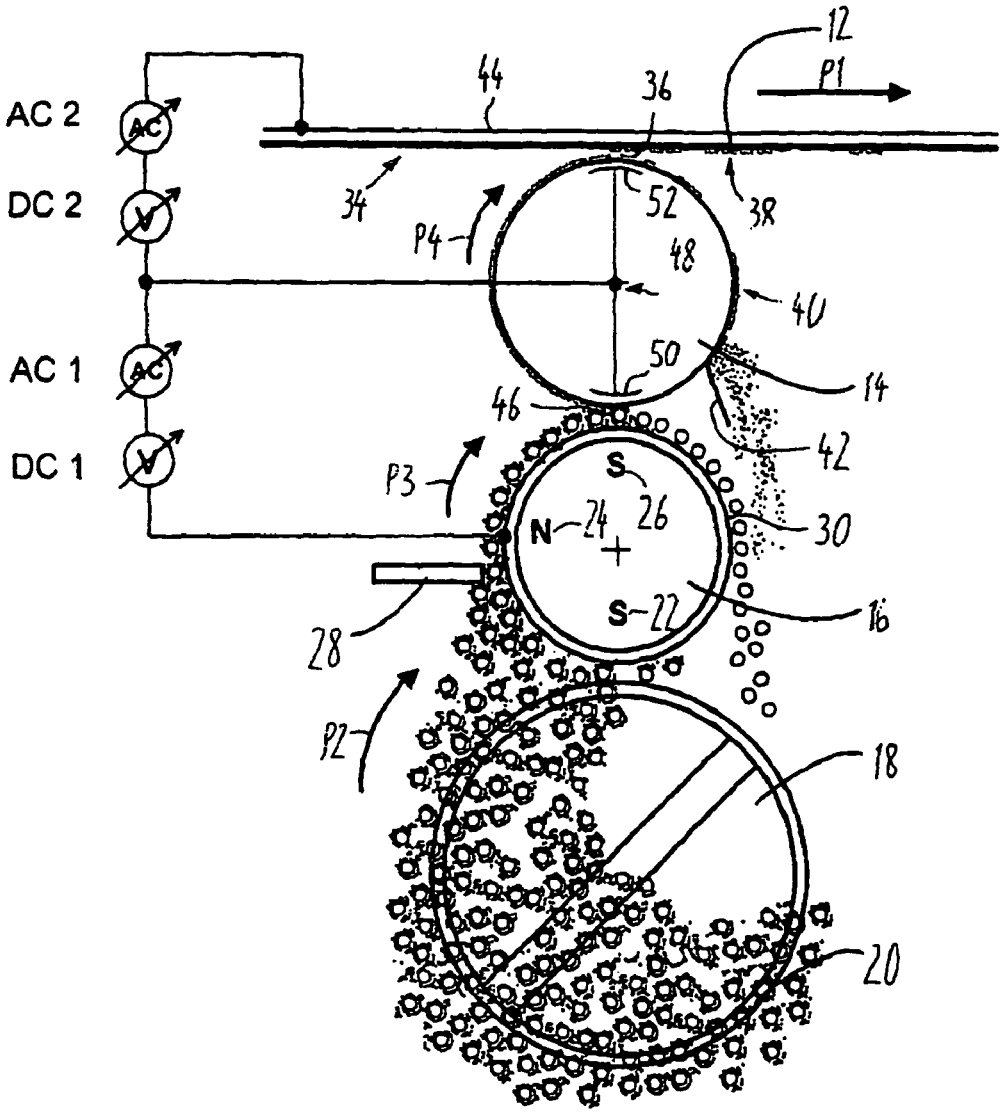
FIG. 2 an arrangement for inking of a photoconductor belt with the aid of an applicator roller according to a second embodiment of the invention.

The developer unit 10 in FIG. 2 is shown according to a second embodiment of the invention. Identical elements have identical reference characters. In contrast to the embodiment according to FIG. 1, in the embodiment 2 a stationary counter-electrode 48 with two electrode plates 50, 52 is arranged inside the applicator roller 14. The electrode plate 5 is arranged opposite the roller 16 in the region 46 with the smallest separation between the applicator roller 14 and the magnet roller 16. The counter-electrode 48 with the electrode plates 50, 52 is connected with the second potential of the direct voltage source DC1 and the first potential of the direct voltage source DC2 in the same manner as the metal casing 32 according to the first embodiment according to FIG. 1. Given the embodiment according to FIG. 2 a plastic roller that comprises no metal casing 32 can thus also be used as an applicator roller 14.

In the embodiment according to FIG. 2, an alternating voltage that is generated with the aid of an alternating voltage source AC1 is superimposed on the direct voltage generated by the direct voltage source DC1. The magnitude of the alternating voltage generated by the alternating voltage source AC1 can advantageously be adjusted in a continuously-variable manner with the aid of a control unit. The alternating voltage generated via the alternating voltage source AC1 serves in particular in that the toner particles adhering to the carrier particles are detached from the carrier particles, in particular in the region 46, whereby the detached toner particles are drawn in the direction of the surface of the applicator roller 14 with the aid of the direct voltage generated by the direct voltage source DC1 and electrostatically adhere on the surface of the applicator roller 14.

An alternating voltage generated by an alternating voltage source AC2 is superimposed in the same manner on the direct voltage generated by the direct voltage source DC2. The toner particles are detached from the surface of the applicator roller 14 with the aid of the voltage generated by the alternating voltage source AC1. As an alternative to the embodiment shown in FIG. 2, the applicator roller can comprise a metal casing that serves as an electrode, which metal casing is similar to the metal casing 32 according to FIG. 1. The second electrode plate 52 is arranged stationary inside the applicator roller 52, opposite the transfer printing region 36.

Only one alternating voltage source AC1 or AC2 can also be provided in other embodiments.

In the described embodiments, the carrier particles have a diameter of approximately 50 μm and are represented as crosses in FIGS. 1 and 2. The toner particles have a diameter of approximately 7 μm and are represented in FIGS. 1 and 2 as points. The layer thickness generated on the applicator roller 14 can be controlled by the alteration of the direct voltage DC1, both in the embodiment according to FIG. 1 and in the embodiment according to FIG. 2.

If the layer thickness of the generated toner particle layer on the applicator roller 14, on the photoconductor belt 12 or on a subsequent carrier material 100 (such as, for example, on an endless transfer belt or a carrier material to be printed) is subsequently determined, such as by a measurement unit 45 making measurements 45A on the applicator or 45B on the photoconductor, this determined layer thickness can thus be compared in a comparison unit 46 with a desired value 47 and the level of the direct voltage generated by the direct voltage source DC1 can be controlled via output line 48 dependent on the comparison result, whereby the layer thickness is regulated. Alternatively or additionally, the degree of inking of the toner particle layer generated on the applicator roller 14, the photoconductor belt 12 or on a subsequent carrier material can be determined and compared with a desired value. The voltage source DC1 is controlled dependent on the comparison result in order to adapt the layer thickness of the toner particle layer to be generated on the applicator roller 14 to the desired value. An optical sensor, a capacitive sensor and/or a laser triangulation sensor can thereby be used as a sensor.

Upon assembly in an electrophotographic printer or copier, the developer unit 10 is advantageously enclosed by a suitable housing.

The developer stations 10 with applicator rollers 14 according to FIGS. 1 and 2 generate a toner particle layer on the applicator roller 14 with the aid of a two-component magnet brush, which toner particle layer adheres electrostatically on the applicator roller. The force vector of the electrical field generated by the direct voltage DC1, which electrical field acts on the toner particles, is directed in the direction of the applicator roller 14. In the regions of the photoconductor belt to be developed, i.e. in the regions to be inked, the entire toner particle layer is transferred from the applicator roller 14 onto the photoconductor belt 12 across the air gap between applicator roller 14 and photoconductor belt 12. Only a very slight residue remains in this region on the surface of the applicator roller 14, which residue is constant, independent of the toner layer deposited on the applicator roller 14.

The layer thickness of the toner particle layer on the photoconductor belt 12 in the regions 38 to be inked is thus independent of the auxiliary transfer voltage DC1. The strength of the electrical field of the direct voltage sources DC1 and DC2 can advantageously be adjusted in a continuously-variable manner, whereby a very variable layer thickness adjustment is possible in wide ranges.

As already mentioned, existing process fluctuations of the electrophotography process can be compensated to the greatest extent possible via a regulation of the layer thickness since the layer thickness can be altered simply and quickly with the aid of the direct voltage source DC1. The generated printing group inking (advantageously on the photoconductor belt) is initially determined as a real inking with the aid of a suitable sensor arrangement. Given a deviation of this determined real inking from a desired inking, the direct voltage generated by the voltage source DC1 is varied with the aid of a control loop until the determined real inking then corresponds to the desired inking.

For example, if the determined real inking is less than the desired inking, the voltage of the direct voltage source DC1 is thus increased, whereby the toner quantity deposited on the surface of the applicator roller 14 and thus the toner quantity developed on the photoconductor belt 12 increases and approaches the desired inking. However, if the determined real inking is greater than the desired inking, the voltage of the direct voltage source DC1 is thus correspondingly reduced. Process fluctuations can thereby be reacted to quickly and flexibly, which is not possible via the regulation (described in the specification preamble) of the re-feed of toner material into the developer unit 10.

The mixture parameters of the two-component mixture that are varied as a result of the aging of the carrier particles do in fact influence the toner agglomeration on the carrier particles; however, this is compensated via the described regulation of the layer thickness or of the inking, such that a constant inking of the charge images to be developed occurs at constant quality. The carrier particles can thereby also be used longer in the electrophotographic process in the developer unit 10, whereby costs can be reduced.

Although preferred exemplary embodiments are shown and described in detail in the drawings and in the preceding specification, this should be viewed as purely exemplary and not as limiting the invention. It is noted that only the preferred exemplary embodiments are shown and described, and all variations and modifications that presently and in the future lie within the protective scope of the invention should be protected.

The invention claimed is:

1. A method for generation of a toner particle layer with a preset layer thickness on a surface of an applicator element, comprising the steps of:

directing a two-component mixture of electrically charged toner particles and carrier particles on an outer surface of a roller adjacent a surface of the applicator element to be inked;

upon passage of the two-component mixture, transferring at least a portion of the toner particles onto the surface of the applicator element to be inked;

generating an electrical field that exerts at least one force on a portion of the electrically-charged toner particles located between the surface of the roller and the surface of the applicator element to be inked;

varying a strength of the electrical field in order to adjust a layer thickness of a layer of the toner particles transferred onto the surface of the applicator element to be inked;

inking a toner image layer on a surface of a photoconductor with aid of the applicator element;

detecting with aid of a measurement arrangement a thickness of at least one region of the toner image layer inked on the surface of the photoconductor with the aid of the applicator element as a real value; and comparing the real value with a desired value determined by a preset layer thickness; and controlling a strength of the electrical field dependent on a deviation of the determined real value from the desired value.

2. A method according to claim 1 wherein the real value is determined with aid of a capacitive layer thickness sensor, an optical layer thickness sensor, or a sensor for detection of optical density of the inked toner image layer on the photoconductor.

3. A method according to claim 1 wherein the strength of the electrical field is varied in a continuously-variable manner for continuously-variable variation of the layer thickness on the applicator element.

4. A method according to claim 1 wherein the surface of the applicator element to be inked is directed past the surface of the roller, the rotation direction of the roller is the same as a transport direction of the applicator element, and a rotation speed of the roller and of the applicator element are substantially equal.

5. A method according to claim 1 wherein the applicator element comprises an applicator roller or an applicator belt.

6. A method according to claim 1 wherein at least one magnet element is arranged stationary within the roller, the magnetic field of which magnet element acting on the carrier particles such that an accumulation of the two-component mixture raised on the surface of the roller is formed.

7. A method according to claim 6 wherein the magnet element is arranged at appoint with a least separation between the applicator element and the roller, and an axis of poles of the magnet element is aligned radially relative to the roller.

8. A method according to claim 1 wherein a charge image located on the photoconductor is inked and developed with aid of the layer of toner particles generated on the applicator element.

9. A method according to claim 8 wherein the magnet element comprises a permanent magnet and/or an electromagnet.

10. A method according to claim 1 wherein the two-component mixture is prepared with aid of a mixture preparation device such that it comprises a preset proportion of toner particles.

11. A method according to claim 1 wherein the layer thickness on the applicator element is detected with aid of a sensor arrangement, whereby in particular the layer thickness of the layer formed by the toner particles is detected by the sensor arrangement.

12. A method according to claim 11 wherein a capacitive sensor is used as the sensor arrangement.

13. A method according to claim 1 wherein the layer thickness generated via the toner particles transferred onto the applicator element is regulated.

14. A method according to claim 13 wherein the strength of the electrical field is used as an adjustment variable, wherein the electrical field is advantageously set by changing a potential difference or an applied voltage between the surface of the roller and the surface of the applicator element.

15. A method according to claim 1 wherein a control deviation is determined with aid of a comparison between the measurement value determined by the sensor arrangement and the desired value.

16. A method according to claim 1 wherein the roller comprises a metal casing that extends substantially across an entire length of the roller, the layer serving as an electrode; and a base body of the roller comprising a metal casing.

17. A method according to claim 1 wherein the applicator element comprises an electrically-charged layer that extends in a plane parallel to the surface of the applicator element and serves as an electrode.

18. A method according to claim 1 wherein stationary electrodes arranged opposite one another are arranged in the applicator element and/or in the roller.

19. A method according to claim 1 wherein a mixing roller is provided via which the carrier particles and toner particles contained in the two-component mixture are uniformly stirred and with aid of which the two-component mixture is prepared.

20. A device for generation of a toner particle layer with a preset layer thickness on a surface of an applicator element which inks a toner image layer on a surface of a photoconductor, comprising:

a roller whose outer surface is for adherence to a two-component mixture made up of electrically-charged toner particles and ferromagnetic carrier particles;

the two-component mixture adhering on the outer surface of the roller being directed onto the surface of the applicator element to be inked;

an electrical field generator that exerts at least one force on a portion of the electrically-charged toner particles of the two-component mixture located between the surface of the roller and the surface of the applicator element to be inked;

an electric field strength variation device which adjusts a layer thickness of the toner particle layer formed by the toner particles transferred onto the surface of the applicator element to be inked;

a measurement arrangement for determination of a real value of a layer thickness of at least one region of the toner image layer inked on the surface of the photoconductor with the aid of the applicator element;

a comparison unit which compares the determined real value with a desired value determined by a preset layer thickness; and the electric field strength variation device controlling a strength of the electrical field dependent on a deviation of the determined real value from the desired value.

* * * * *